US006069589A

United States Patent [19]

Lewis, Jr. et al.

[11] Patent Number: 6,069,589

[45] Date of Patent: May 30, 2000

[54] LOW PROFILE DUAL FREQUENCY MAGNETIC RADIATOR FOR LITTLE LOW EARTH ORBIT SATELLITE COMMUNICATION SYSTEM

[75] Inventors: Donald R. Lewis, Jr., Conyers; Rodolfo Munoz, Alpharetta; Robert L. Moore, Flowery Branch; Binh T. Phan, Duluth; Samuel H. Walker, Suwanee, all of Ga.

[73] Assignee: Scientific-Atlanta, Inc., Norcross, Ga.

[21] Appl. No.: 09/350,427

[22] Filed: Jul. 8, 1999

[51] Int. Cl.[7] ..... H01Q 13/10

[52] U.S. Cl. ..... 343/767; 343/770; 343/700 MS

[58] Field of Search ..... 343/767, 770, 343/713, 872, 906, 700 MS, 725

[56] References Cited

U.S. PATENT DOCUMENTS

| | | | |
|---|---|---|---|
| 4,370,658 | 1/1983 | Hill | 343/713 |
| 4,647,940 | 3/1987 | Traut et al. | 343/770 |
| 5,003,318 | 3/1991 | Berneking et al. | 340/700 MS |
| 5,047,787 | 9/1991 | Hogberg | 343/767 |
| 5,119,107 | 6/1992 | Wildey et al. | 343/770 |
| 5,486,836 | 1/1996 | Kuffner et al. | 343/700 MS |
| 5,572,222 | 11/1996 | Mailandt et al. | 343/700 MS |
| 5,581,266 | 12/1996 | Peng et al. | 343/767 |
| 5,640,139 | 6/1997 | Egeberg | 340/426 |
| 5,652,595 | 7/1997 | Ahrens et al. | 343/700 MS |
| 5,872,544 | 2/1999 | Schay | 343/770 |

*Primary Examiner*—Tan Ho

*Attorney, Agent, or Firm*—Kelly A. Gardner; Kenneth M. Massaroni; Hubert J. Barnhardt III

[57] ABSTRACT

A dual-frequency antenna (100) includes a transmit element (110) that is substantially planar and that is formed from a conductive material, such as aluminum, having a loaded slot (140) formed therethrough for transmission of first radio frequencies. The antenna (100) also includes a receive element (115) that is substantially planar and that is also formed from a conductive material having a loaded slot (155) formed therethrough for reception of second radio frequencies. The transmit and receive elements (110, 115) are mounted in a single plane adjacent to a ground plane (105) that is held only a small distance from the transmit and receive elements (110, 115). Preferably, the height of the antenna (100), i.e., the distance between the transmit and receive elements (110, 115), and the ground plane (105) is equal to or less than about 1.4 centimeters for low-profile mounting on truck-drawn trailers.

15 Claims, 8 Drawing Sheets

LOW PROFILE DUAL FREQUENCY MAGNETIC RADIATOR FOR LITTLE LOW EARTH ORBIT SATELLITE COMMUNICATION SYSTEM

TECHNICAL FIELD

This invention relates in general to the field of antennas, and in particular to dual frequency, low profile magnetic antennas.

BACKGROUND

Little low earth orbit (LLEO) satellite systems provide low cost modems that communicate with satellites. These modems can be attached to customer assets such as trucks, trailers, train cars, shipping containers, etc. to give the Customer the ability to track and monitor assets across the world. The modems typically communicate with the LLEOs via an antenna, which transmits and, when required, receives information from the satellite. Conventional designs for antennas for this application include only electrical antennas, which have relatively low radiation efficiencies and are relatively large in size in comparison with other some other types of antennas.

Modems for LLEO applications are generally installed within a truck or a truck-drawn trailer to protect the modem from damage, theft, and vandalism. The antenna, on the other hand, must be installed on the outside of the trailer to have visibility to the sky, but there is little clearance and little available space on the outside of the trailer, and most types of smaller antennas suffer from narrow bandwidths and low efficiency when mounted relatively close to a ground plane, which is the case for LLEO antennas mounted on trailers. Additional problems encountered for LLEO communication applications include the low elevation coverage required, the dual-frequency nature of the application, the desired non-intrusive features of the application, and cost considerations, to name but a few.

DETAILED DESCRIPTION OF A PREFERRED EMBODIMENT OF THE INVENTION

Figure 1:
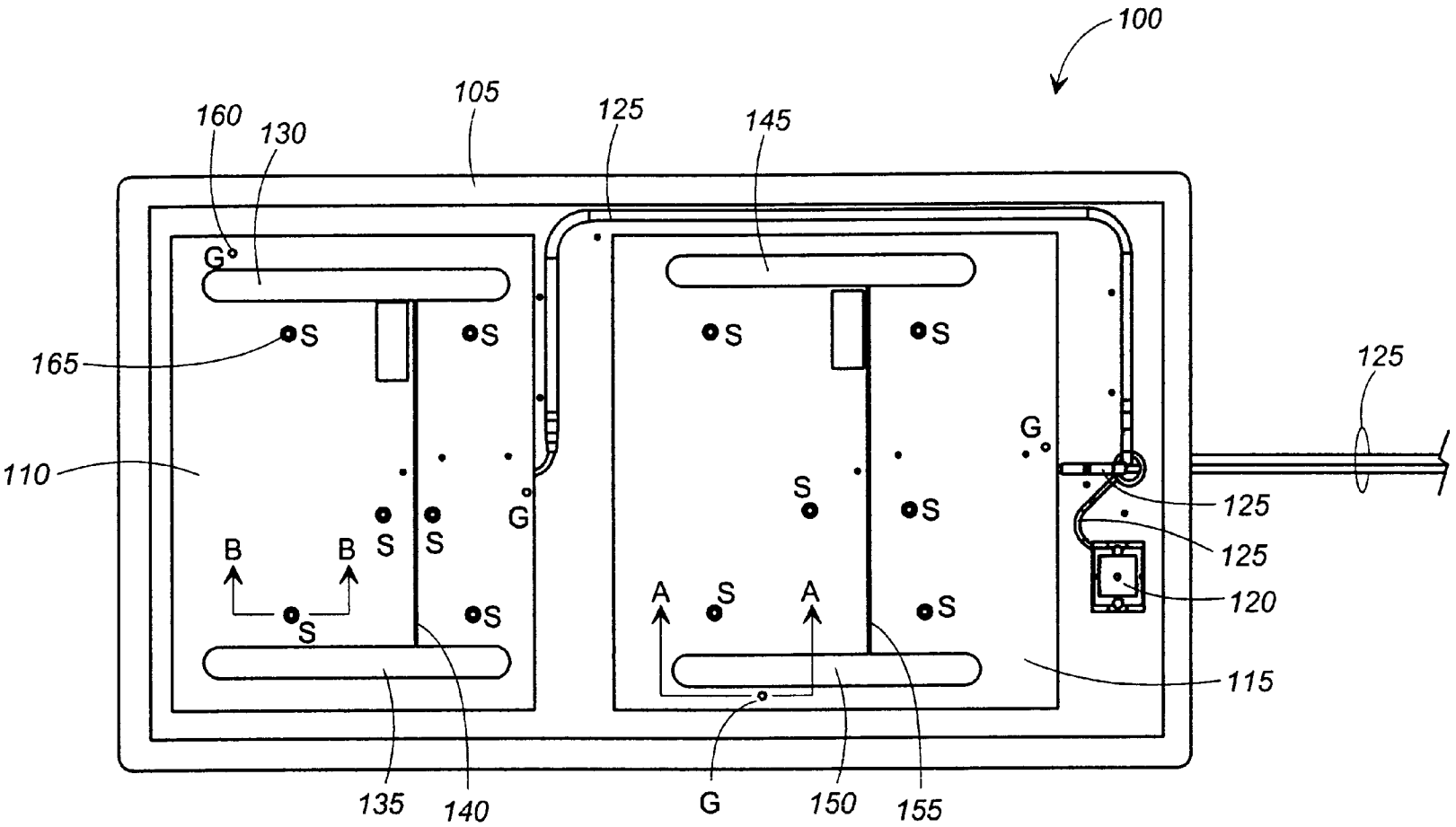
FIG. 1 is a top view of an antenna comprising transmit and receive units and a ground plane and formed according to the present invention.

FIG. 1 is a top view of an antenna 100 for use in LLEO applications. The antenna 100 is a dual frequency slot array antenna having a resonance frequency that is lowered by grounding the antenna at multiple points and by loading slot ends, thereby decreasing the antenna size. The antenna's dual-frequency nature is obtained by the use of two resonant magnetic antennas in close proximity. Due to its low-profile nature, the antenna 100 can be mounted by trailer owners to the exterior of a truck-drawn trailer to minimize the likelihood of fear of vandalism, damage, and theft. Since the low profile of the antenna 100 makes it less noticeable, it is also likely that, if a trailer is stolen, the thief will not know to disable the modem or antenna that enables satellite tracking of the trailer.

The antenna 100 of the present invention features dual resonance frequencies in approximately one-quarter of the space required by equivalent electrical antennas or unloaded slot designs. The antenna's overall cavity height is also greatly reduced. Features of the antenna 100 include:

- Use of magnetic radiators for low profile inconspicuous conformal antennas for uplink and downlink communications.
- Increased bandwidth characteristics at both resonance frequencies when compared to equivalent electrical antennas.
- Reduced antenna volume utilizing slot end-loading techniques and short strips.
- Dual frequency, for example 137 MHz and 150 MHz, operation with separate transmit and receive elements.
- Transmit-to-receive isolation of greater than 20 dB.
- An optional integrated Global Positioning System (GPS) patch.
- Thorough radiation pattern providing necessary coverage of satellite network or constellation.
- Wide bandwidth (6 dB return loss bandwidth >1.5 MHz) via superior matching across satellite frequencies.

The antenna 100 includes a transmit element, or radiator, 110; a receive element 115; and a ground plane 105 to which the transmit and receive elements 110, 115 are mechanically coupled by insulative spacers 165 (designated by the letter "S") and electrically coupled by conductive fasteners 160 (designated by the letter "G"). The insulative spacer may also be a low-loss dielectric block that serves the same Support function. Other unlabeled via holes shown in FIG. 1 indicate locations at which the elements 110, 115 could be electrically coupled to external circuitry or devices.

The transmit element 110, the receive element 115, and the ground plane 105 are all formed from an electrically conductive material, such as aluminum or copper. The transmit element 110 and the receive element 115 are respectively coupled to a separate electronic device, such as an LLEO modem (not shown), by cables 125. The antenna 100 may include an optional Global Positioning System patch 120, in which case the patch 120 is also coupled to external circuitry by a cable 125.

The transmit and receive elements 110, 115 each, according to the present invention, form a loaded slot antenna. The transmit element 110 therefore includes a slot 140 that is loaded by apertures 130, 135 formed in the transmit element material at the respective ends of the slot 140. Likewise, the receive element 115 includes a slot 155 that is loaded by apertures 145, 150 formed in the receive element material at the respective ends of the receive slot 155. The loaded slot 140, 155 for each of the transmit and receive elements 110, 115 is sized and located appropriately for reception/transmission of a desired frequency. By way of example, the transmit element 110 of the antenna 100 can be configured to transmit radio frequency signals at about 150 MHz, and the receive element can be configured to receive radio frequency signals at about 137 MHz.

Figure 2:
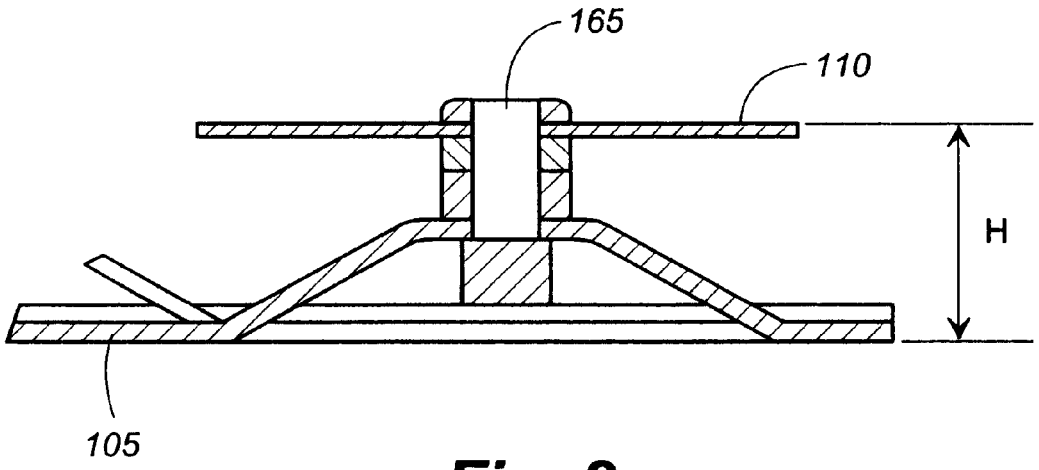
FIGS. 2 and 3 are sectional views of fasteners for coupling the antenna of FIG. 1 to the ground plane according to the present invention.
Figure 3:
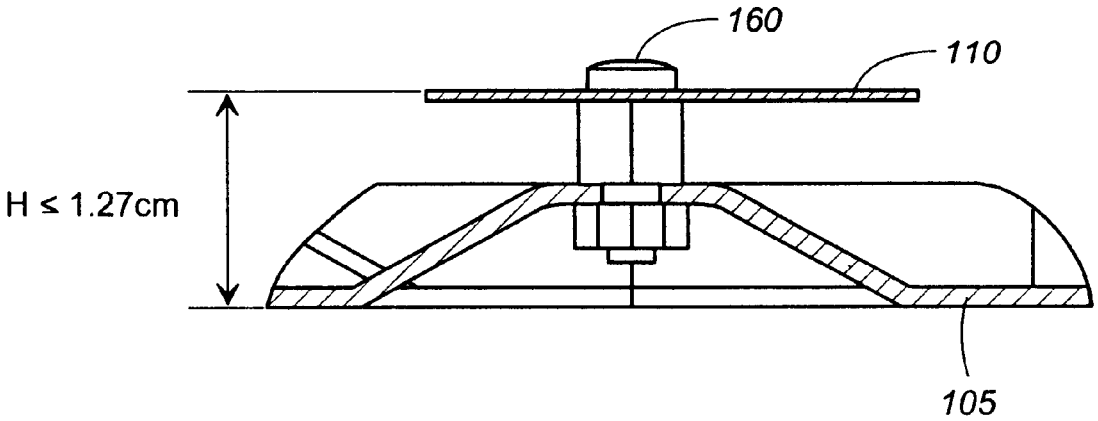

Referring next to FIGS. 2 and 3, side views along sections A—A and B—B of FIG. 1 are respectively shown. In FIG. 2, a side, sectional view depicts the use of an electrically non-conductive spacer 165 to space one of the antenna elements, such as the transmit element 110, a predetermined distance from the ground plane 105. FIG. 3 shows an electrically conductive fastener 160 that can be used to electrically and mechanically couple the elements 110, 115 to the ground plane 105. Preferably, the spacers 165 and the fasteners 160 hold the transmit and receive elements 110, 115 of the antenna 105 at a distance of less than or equal to about 2.54 centimeters (cm) from the ground plane 105, and preferably at a maximum of about 1.4 cm from the ground plane 105, or less than 1/143 wavelength, thereby providing the needed low profile requirement for its application. In this manner, the antenna 105 can be formed into a low profile configuration suitable for mounting on a truck-drawn trailer.

Figure 4:
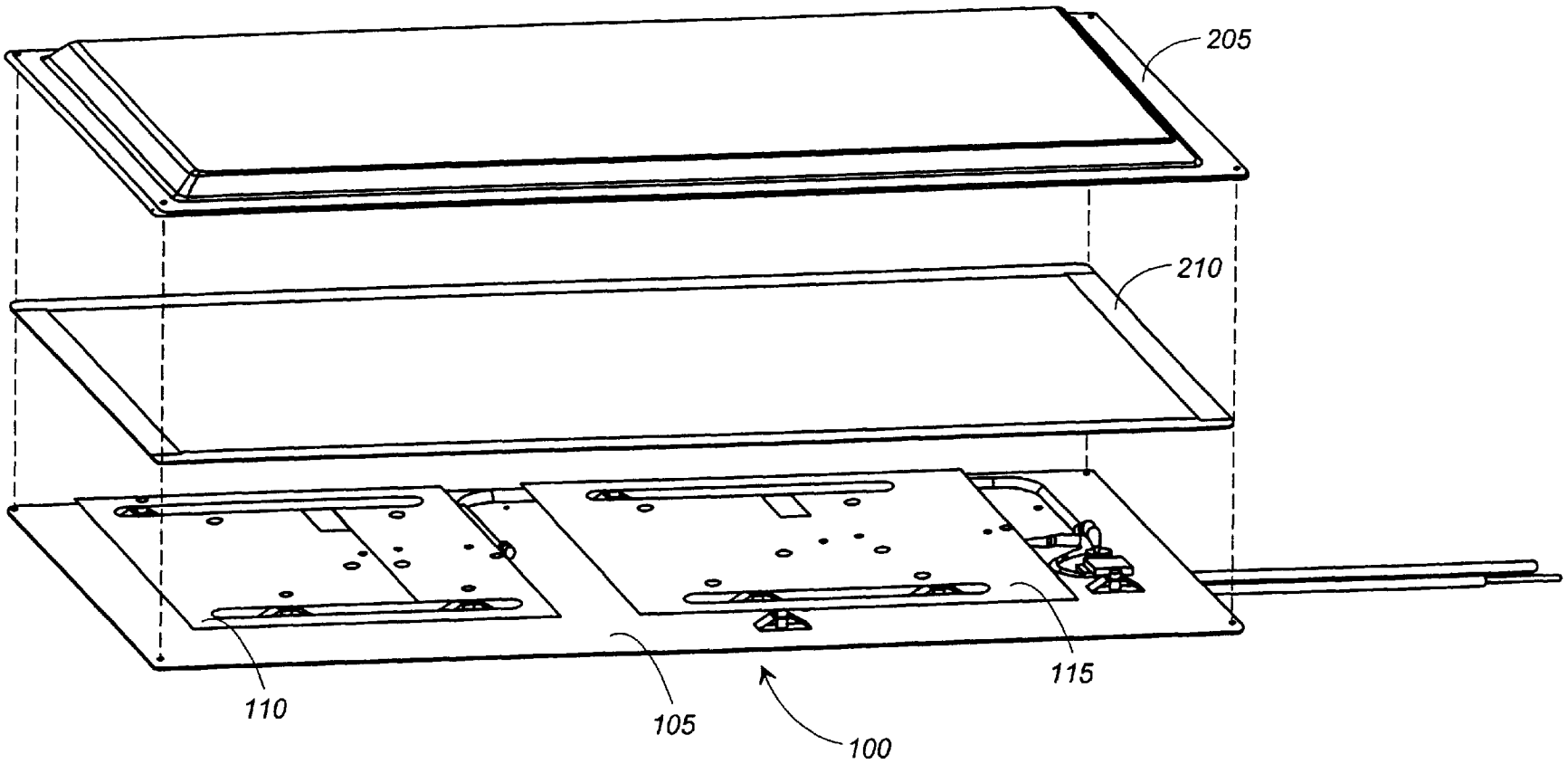
FIG. 4 is an exploded perspective view of the antenna of FIG. 1, a protective radome, and an adhesive element for holding the radome and antenna together according to the present invention.

FIG. 4 is an exploded view of the antenna 100, a protective radome 205, and adhesive 210 for mounting the radome 205 to the antenna 100. When the antenna 100 is mounted to a trailer, the radome 205 covers the antenna 100 and protects it from damage, such as that caused by rain, vandalism, or road debris. The radome 205 is formed from an electrically non-conductive material, such as plastic.

Figure 5:
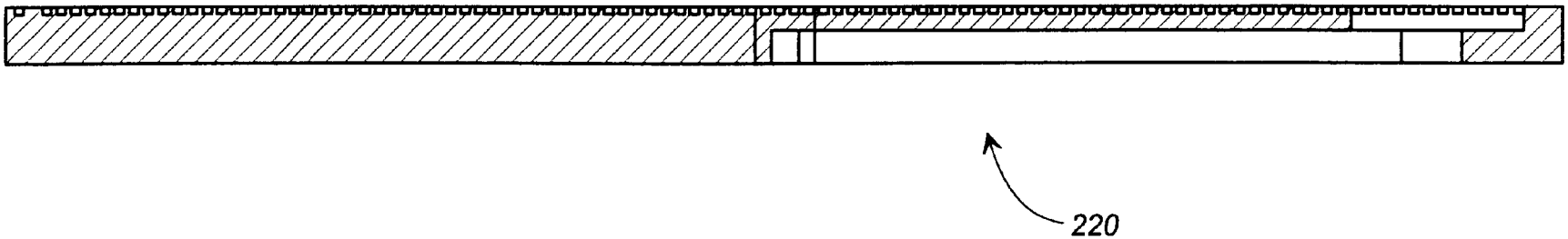
FIG. 5 is an optional spacer that can be used between the antenna and the ground plane in accordance with the present invention.

FIG. 5 shows an additional foam element 220 that may be used in place of or in addition to the insulative spacers 165 (FIG. 2) within the LLEO antenna system according to the present invention. The foam 220 can be inserted between the transmit and receive elements 110, 115 and the ground plane 105 to provide additional cushioning and mechanical integrity, which may be quite important for applications in which the antenna 100 is mounted to a moving vehicle, such as a truck-drawn trailer.

Figure 6:
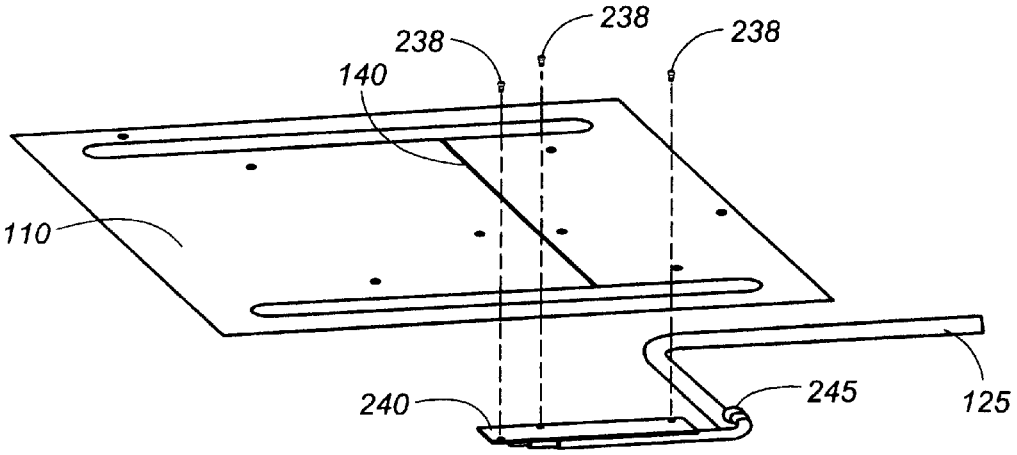
FIGS. 6–8 are illustrations showing electrical and mechanical coupling to the antenna of FIG. 1 in accordance with the present invention.
Figure 7:
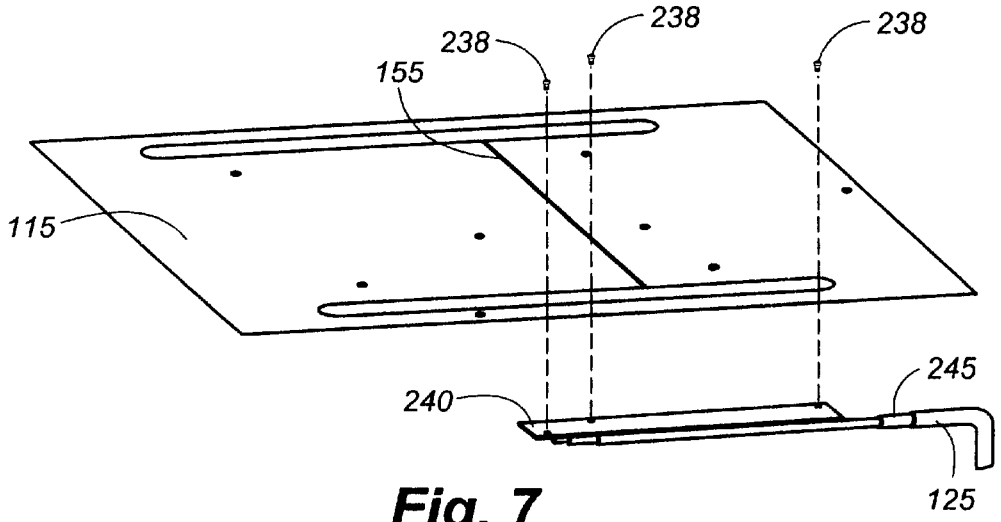
Figure 8:
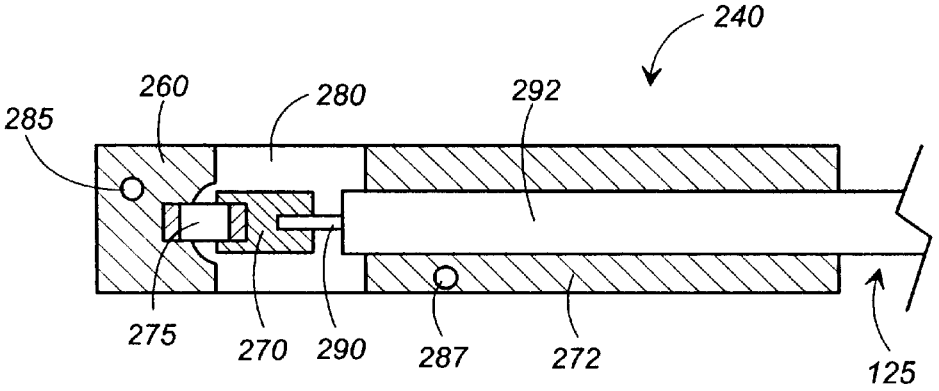

FIGS. 6–8 are illustrations depicting the use of a substrate 240 that is electrically coupled to each of the transmit element 110 and the receive element 115 to transmit signals thereto and therefrom, respectively. The substrate 240 includes a first conductive region 260 formed, for example, by plating a conductive material onto the substrate 240 and second and third conductive regions 270, 272 that can be formed in similar manner. On the substrate 240, the conductive regions 260, 270, 272 are electrically insulated from each other by a nonconductive region 280 for electrically isolating each conductive region 260, 270, 272. A capacitor 275, such as a 2.5 picofarad (pf) capacitor, is electrically coupled, such as by soldering, between the first and second conductive regions 260, 270. Since the capacitor 275 is mounted over the nonconductive region 280 of the substrate 240, it is advantageously protected from breakage by the additional mechanical support provided by the nonconductive region 280.

The first conductive region 260 of the substrate 240 for the transmit element 110 is electrically coupled to the transmit element 110 on a first side of its slot 140, such as by using a conductive fastener 238 inserted through a hole formed in the transmit element 110 and through a corresponding hole 285 formed in the first conductive region 260 of the substrate 240. The third conductive region 272 is electrically coupled to the transmit element 110 on the opposite side of the slot 140 via one or more additional conductive fasteners 238 at location 287.

An electrical cable 125 can be electrically coupled, such as by soldering, to the substrate 240 for routing signals from external circuitry (not shown) to the transmit portion 110 of the antenna 100. More specifically, when a coaxial cable is used, the center conductor 290 is electrically coupled to the second conductive region 270, and the outer conductor 292 is electrically coupled to the third conductive region 272. In this manner, signals are capacitively coupled from the first conductive region 260 to the cable 125. A choke balun 245 (FIGS. 6 and 7) mounted around the cable 125 presents a high impedance to current on the outside of the cable 125, thereby choking off these currents. The substrate 240 for the receive element 115 of the antenna 100 is formed and electrically coupled to the receive element 115 in like manner.

Figure 9:
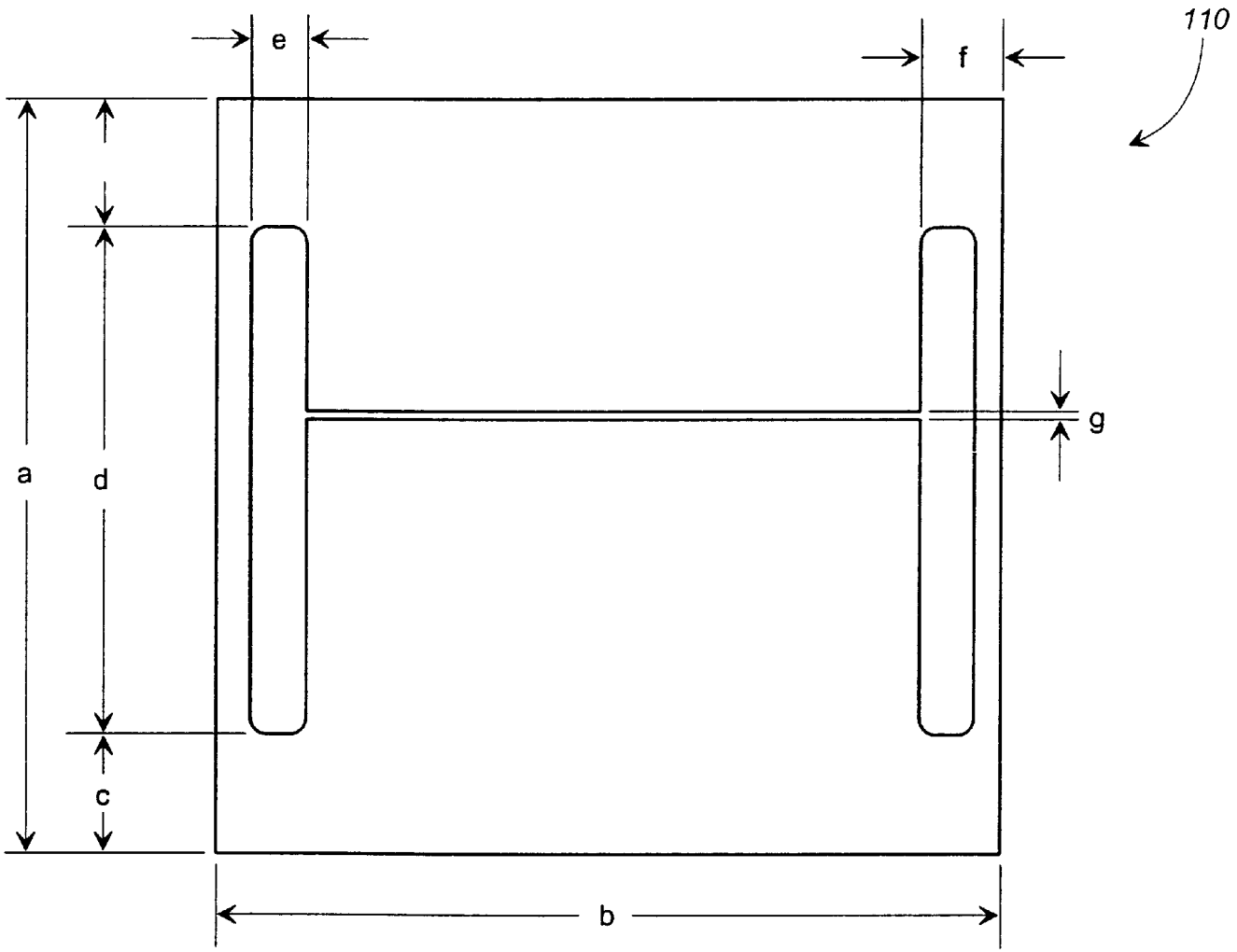
FIGS. 9 and 10 are top views of the transmit and receive units of the antenna of FIG. 1 according to the present invention.
Figure 10:
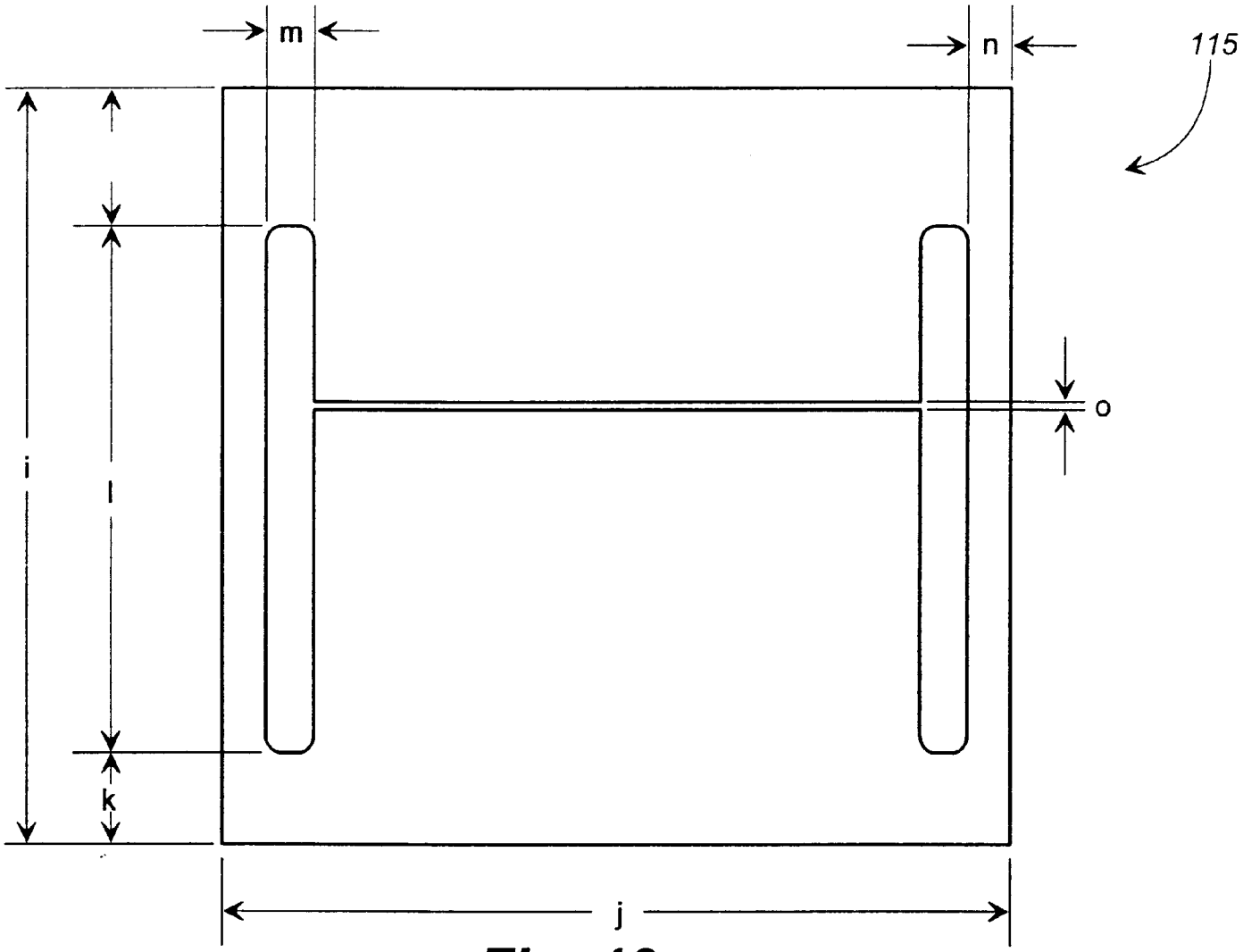

FIGS. 9 and 10 are top views of the transmit element 110 and the receive element 115, respectively. The below tables, in conjunction with FIGS. 9 and 10, provide mechanical dimensions for an example antenna 100 that was constructed to transmit at approximately 150 MHz and receive at approximately 137 MHz.

TABLE 1

| Transmit Element Dimensions | |
|---|---|
| a) | 27.94 cm |
| b) | 30.48 cm |
| c) | 4.216 cm |
| d) | 18.898 cm |
| e) | 2.311 cm |
| f) | 1.156 cm |
| g) | 0.290 cm |

TABLE 2

| Receive Element Dimensions | |
|---|---|
| i) | 27.94 cm |
| j) | 30.48 cm |
| k) | 3.429 cm |
| l) | 19.710 cm |
| m) | 1.605 cm |
| n) | 1.859 cm |
| o) | 0.345 cm |

It will be appreciated by one of ordinary skill in the art that the dimensions set forth above for the transmit and receive elements 110, 115 of the antenna 100 can vary within certain tolerances without materially affecting antenna performance and can be substantially different for alternative transmit and receive frequencies. What is important is that each element 110, 115 includes a loaded slot and that the distance between the transmit and receive elements 110, 115 and the ground plane 105 (FIG. 1) is relatively small, providing a low profile for mounting on a trailer.

Although the example antenna 100 described herein includes a ground plane 105, it should be understood that the ground plane 105 could be eliminated entirely when a surface of a truck-draw trailer to which the antenna 100 is mounted is suitable for use as the ground plane. In such a circumstance, a spacer (such as a foam insert) could be used to hold the transmit and receive elements 110, 115 away from the electrically conductive portion of a trailer that is to be used as a ground plane, and rivets or other conductive fasteners could be used to electrically couple the elements 110, 115 to the trailer at appropriate locations.

According to the present invention, the antenna 100 could also be embedded into the truck trailer so that its appearance is not noticeable and to further reduce the profile of the antenna 100. Alternatively, the antenna 100 could be disguised in other manners, such as by manufacturing a protective radome or cover that is similar in appearance to other common and inexpensive trailer items, such as wind baffles or air dams. In this manner, the likelihood of theft or vandalism can be minimized without affecting antenna performance.

Figure 11:
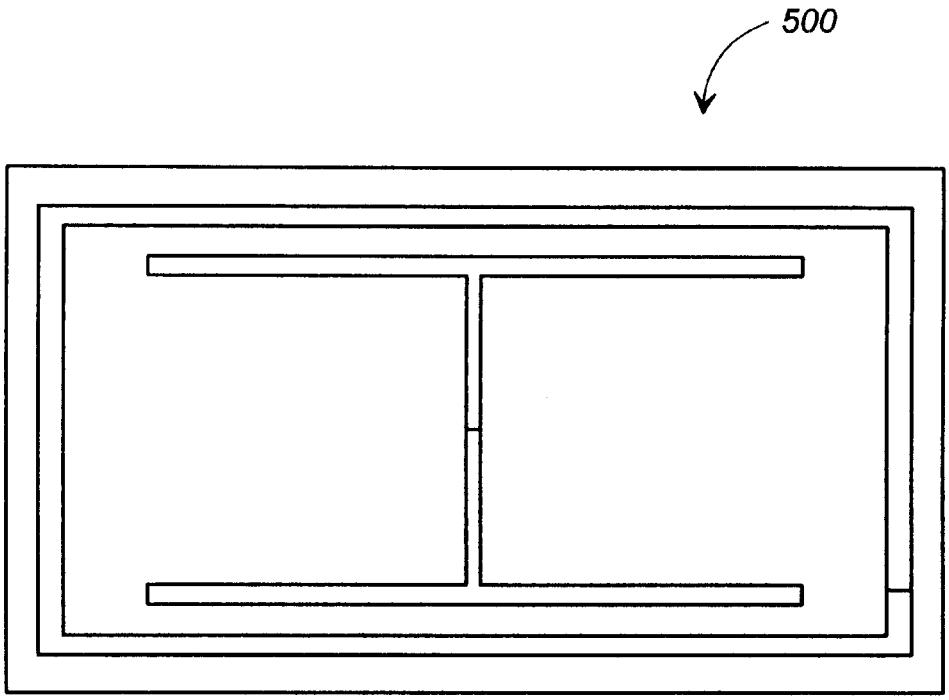
FIGS. 11 and 12 depict transmit and receive elements of antennas formed in accordance with alternative embodiments of the present invention.
Figure 12:
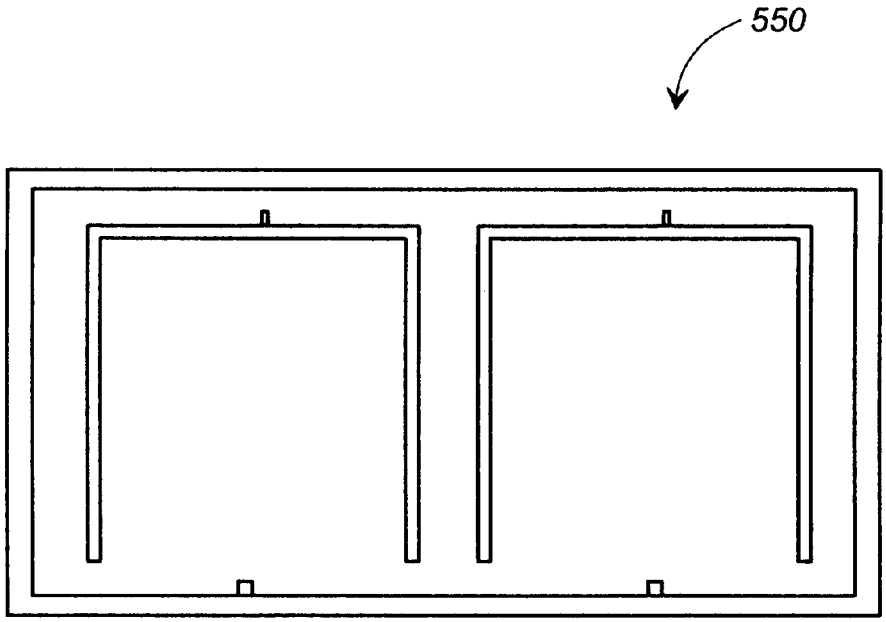

FIGS. 11 and 12 depict alternate embodiments of the present invention. In FIG. 11, a dual-frequency cavity slot/loop array antenna 500 having shorting pins at multiple locations and having loaded slot ends to lower the resonance frequency of the array.

In FIG. 12, a dual-frequency cavity slot array antenna 550 is shown. This antenna 550 also has loaded slot ends and multiple shorting locations to lower the resonance frequency of the array. The dual-frequency natures of both antennas 500, 550 are obtained by varying the effecting coupling between the slots using special capacitance loading between the cavity element and the radiating element.

According to the present invention, the dual-frequency magnetic radiator described above has significant advantages in comparison with prior art antennas typically used in little low earth orbit satellite applications. In particular, the use of a magnetic antenna provides efficient radiation when located in close proximity to a metallic ground plane, such as a truck-drawn trailer, and the use of slot loading in the manner described above minimizes the area required for antenna resonance. Other advantages include significant reduction in the aperture area required for the radiator as a result of use of the described shorting pins and suppression of radiation from the coaxial cable as a result of the integral current balun. Because dual antenna elements are configured to minimize cross-coupling, there are minimal filtering requirements for the attached transceiver. Also, the use of low loss capacitive matching increases antenna gain as compared with typical matching circuits that utilize higher loss inductive matching elements.

While preferred embodiments of the present invention have been illustrated and described, it will be appreciated that the invention is not so limited. Numerous modifications, changes, variations, substitutions, and equivalents will occur to those skilled in the art, and such modifications, changes, variations, substitutions, and equivalents are not considered to depart from the spirit and scope of the present invention as defined by the below claims.

What is claimed is:

1. A dual-frequency antenna, comprising:

a transmit element that is substantially planar, the transmit element comprising a conductive material having a loaded slot formed therethrough for transmission of first radio frequencies;

a receive element that is substantially planar, the receive element comprising a conductive material having a loaded slot formed therethrough for reception of second radio frequencies; and a substrate mounted to the transmit element for transmitting electrical signals to the transmit element from an external device, the substrate comprising:

a first conductive region coupled to a region on a first side of the loaded slot of the transmit element; and a second conductive region coupled to a region on a second side of the loaded slot, opposite the first side, of the transmit element;

a nonconductive region separating the first conductive region and the second conductive region; and a capacitor electrically coupled between the first conductive region and the second conductive region.

2. The dual-frequency antenna of claim 1, wherein the conductive material of the receive and transmit elements is copper.

3. The dual-frequency antenna of claim 1, wherein the conductive material of the receive and transmit elements is aluminum.

4. The dual-frequency antenna of claim 1, further comprising:

a ground plane that is substantially planar and that comprises a conductive material, wherein the ground plane is substantially parallel to a plane in which the transmit element and the receive element are held.

5. The dual-frequency antenna of claim 4, wherein the ground plane is held a predetermined distance from the transmit element and the receive element.

6. The dual-frequency antenna of claim 5, further comprising:

conductive fasteners for electrically coupling the transmit element and the receive element to the ground plane; and a spacer for holding the ground plane the predetermined distance from the transmit element and the receive element.

7. The dual-frequency antenna of claim 6, wherein the spacer comprises a foam insert.

8. The dual-frequency antenna of claim 6, wherein the ground plane comprises a portion of an external vehicle to which the dual-frequency antenna is mounted.

9. The dual-frequency antenna of claim 1, further comprising:

a radome for covering the transmit element and the receive element.

10. The dual-frequency antenna of claim 9, wherein the radome is formed from an electrically insulative material.

11. The dual-frequency antenna of claim 1, wherein the transmit element is configured to transmit radio frequency signals of about 150 MHz.

12. The dual-frequency antenna of claim 1, wherein the receive element is configured to receive radio frequency signals of about 137 MHz.

13. The dual-frequency antenna of claim 1, wherein the loaded slot of the transmit element comprises:

a slot formed through the conductive material of the transmit element, the slot having first and second ends opposite one another;

a first aperture formed at the first end of the slot and perpendicular to the slot; and a second aperture formed at the second end of the slot and perpendicular to the slot, wherein the first and second apertures are substantially parallel to one another, and wherein the first and second apertures load the slot of the transmit element.

14. The dual-frequency antenna of claim 1, wherein the loaded slot of the receive element comprises:

a slot formed through the conductive material of the receive element, the slot having first and second ends opposite one another;

a first aperture formed at the first end of the slot and perpendicular to the slot; and a second aperture formed at the second end of the slot and perpendicular to the slot, wherein the first and second apertures are substantially parallel to one another, and wherein the first and second apertures load the slot of the receive element.

15. A dual-frequency antenna, comprising:

a transmit element that is substantially planar, the transmit element comprising a conductive material having a loaded slot formed therethrough for transmission of first radio frequencies;

a receive element that is substantially planar, the receive element comprising a conductive material having a loaded slot formed therethrough for reception of second radio frequencies; and a substrate mounted to the transmit element for transmitting electrical signals to the transmit element from an external device, the substrate comprising:

a first conductive region coupled to a region on a first side of the loaded slot of the receive element; and a second conductive region coupled to a region on a second side of the loaded slot, opposite the first side, of the receive element;

a nonconductive region separating the first conductive region and the second conductive region; and a capacitor electrically coupled between the first conductive region and the second conductive region.

* * * * *